United States Patent [19]

Lindstrom

[11] 4,018,352

[45] Apr. 19, 1977

[54] ANTI-ROLLBACK MECHANISM FOR MATERIAL HANDLING IMPLEMENT

[75] Inventor: Edgar K. Lindstrom, Wichita, Kans.

[73] Assignee: J. I. Case Company, Racine, Wis.

[22] Filed: July 31, 1975

[21] Appl. No.: 600,717

[52] U.S. Cl. ..... 214/761; 214/140

[51] Int. Cl.[2] ..... E02F 3/86

[58] Field of Search ..... 214/761, 762, 764, 77 P, 214/140

[56] References Cited

UNITED STATES PATENTS

| | | | |
|---|---|---|---|
| 2,768,758 | 10/1956 | French | 214/77 P |
| 2,853,200 | 9/1958 | Beyerstedt | 214/764 |
| 3,045,845 | 7/1962 | Hackett et al. | 214/761 |
| 3,197,051 | 7/1965 | Thickpenny | 214/764 |
| 3,521,781 | 7/1970 | Holsinger et al. | 214/764 |
| 3,539,068 | 11/1970 | Seaberg | 214/764 |

*Primary Examiner*—Frank E. Werner
*Assistant Examiner*—Ross Weaver
*Attorney, Agent, or Firm*—Dressler, Goldsmith, Clement, Gordon & Shore, Ltd.

[57] ABSTRACT

An anti-rollback mechanism for a material handling implement including a unit pivotally mounted on the outer end of the boom of a vehicle is disclosed herein. The anti-rollback mechanism includes a member that is moved with the boom to indicate the position of the boom and prevent actuation of a manual control lever that forms part of the hydraulic circuit for pivoting the unit on the boom. The anti-rollback mechanism incorporates a manual override to allow the operator to tilt the unit on the boom even though the boom is in the completely raised position.

6 Claims, 4 Drawing Figures

ANTI-ROLLBACK MECHANISM FOR MATERIAL HANDLING IMPLEMENT

BACKGROUND OF THE INVENTION

Material handling implements of the type under consideration have been in existance for many years. These implements normally incorporate a vehicle that has a pair of lift arms pivoted at one end on a support portion of the vehicle. A material handling unit, such as a bucket, is pivotally supported on the opposite end of the respective lift arms. The lift arms, which define a boom, are raised and lowered with respect to the vehicle by a pair of fluid rams while the bucket or unit is pivoted on the end of the boom by a single or a pair of fluid rams.

In normal operation of this unit, the boom is placed in a lowered position and the bucket is positioned to have the lower edge or wall generally flat with respect to the ground and the vehicle is driven forwardly to fill the bucket. After the bucket is filled, it is tilted or rolled back with respect to the boom to maintain the contents within the bucket as it is raised to a position enabling dumping of the bucket to transfer the contents to some other location. As the boom is being raised, it is necessary for the bucket to be pivoted with respect to the boom to maintain the bucket in a generally level position and prevent spilling of the contents.

In small compact units of this type, one of the problems encountered is the fact that the bucket is in close proximity above the operator when the boom is in the fully raised position. This presents a considerable hazard if the operator should inadvertently engage the control lever to tilt the bucket rearwardly and possibly spill the contents onto the operator.

To alleviate this problem, many types of mechanisms have been proposed for preventing rearward tilting of the bucket when the boom is in the fully raised position. One type of mechanism incorporates a hydraulic system which prevents rearward pivoting of the bucket when the boom is in the fully raised position. Other types include elaborate mechanical linkages between the bucket and the boom and the boom and/or vehicle.

One of the problems encountered with most of the prior art devices that prevent tilting or "rollback" in the fully raised position is that the operator in many instances is not capable of manually overriding the system should the need arise. There are many instances in which the bucket should be tilted rearwardly in the fully raised position and other times when it is essential that such movement be precluded. Thus, many operators disconnect the entire rollback mechanisms so that the unit is capable of being operated as desired. This of course, is extremely hazardous and can result in serious injury to the operator and damage to the vehicle.

SUMMARY OF THE INVENTION

According to the present invention, a simple and inexpensive mechanism for preventing "rollback" of the bucket with respect to the boom in a raised position incorporates an additional mechanism which allows the operator to manually override the system. The manual override requires an additional manipulation of the control lever so that the operator must be fully cognizant of what he is doing thereby eliminating inadvertent "rollback38 of the bucket in the raised position.

More specifically, the invention is incorporated into a vehicle having a boom pivotally supported at one end with hydraulic means for raising and lowering the boom. A material handling unit is pivotally supported on the free end of the boom and is moved by hydaulic means which includes a lever pivoted about an axis in opposite directions to pivot the unit on the boom.

According to the invention, the vehicle incorporates position defining means adjacent the lever and the position defining means includes an abutment that is disposed in the pivotal path of movement of the lever to prevent actuation of the lever in one direction when the boom is in a fully raised position. The anti-rollback mechanism also incorporates a mechanism for allowing the lever to be moved relative to the abutment to accommodate manual override of the anti-rollback mechanism.

DETAILED DESCRIPTION

Figure 1:
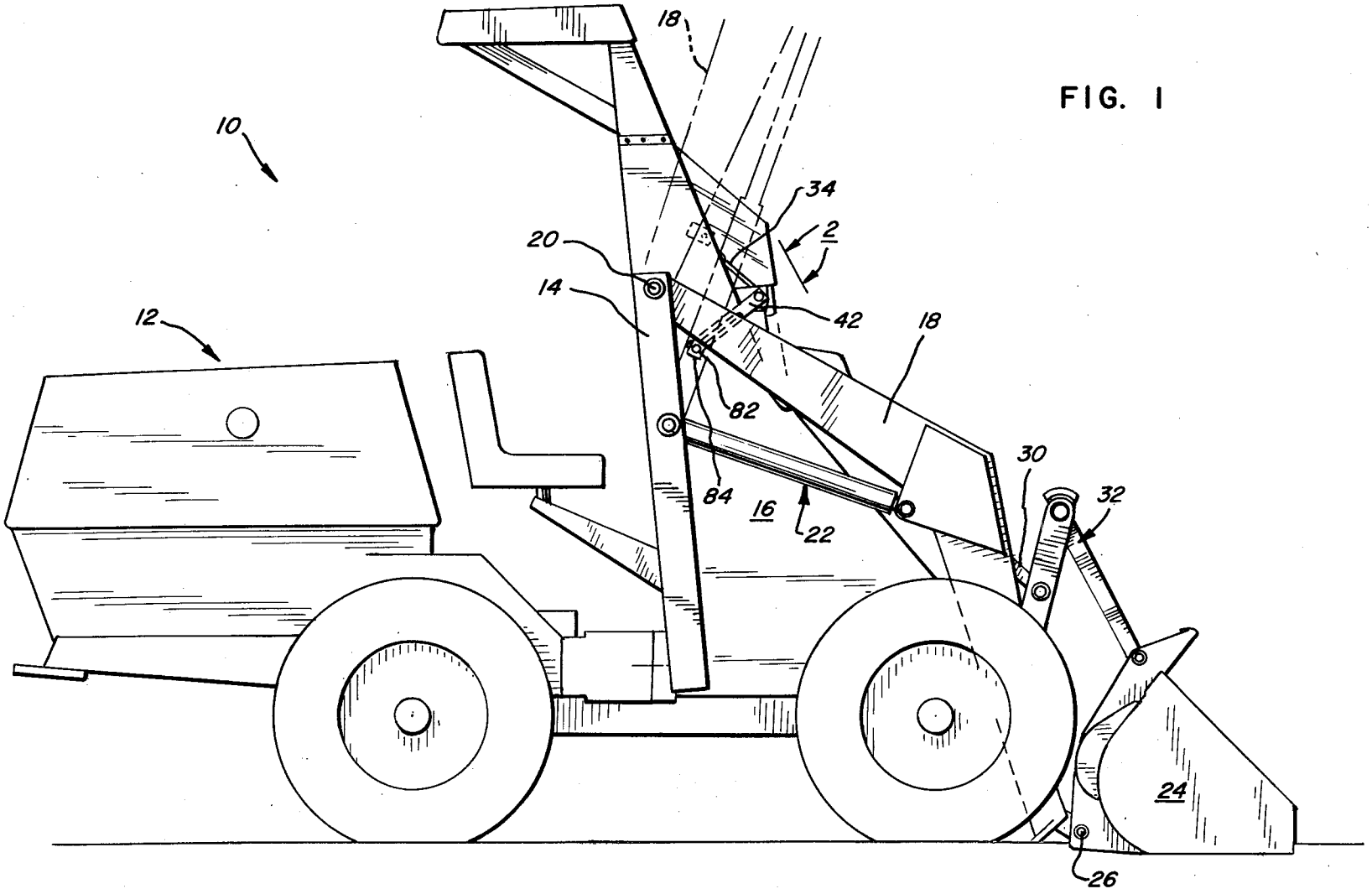
FIG. 1 is a side elevation view of a material handling implement having the present invention incorporated therein.

While this invention is susceptible of embodiment in many different forms, there is shown in the drawings and will herein be described in detail a preferred embodiment of the invention with the understanding that the present disclosure is to be considered as a exemplification of the principles of the invention and is not intended to limit the invention to the embodiment illustrated.

FIG. 1 of the drawings indicates a material handling implement generally designated by the reference numeral 10 and including a vehicle 12 having a pair of vertical fixed supports 14 thereon (one being shown) and located on opposite sides of an operator's compartment 16. A pair of lift arms 18, which define a boom, are pivotally supported at one end by pins 20 on the vertically extending fixed supports 14. Boom 18 is adapted to be pivoted about pins 20 through a fluid ram 22 interposed between support 14 and boom 18.

A material handling unit 24, such as a bucket, is pivotally supported on the outer end of boom or lift arms 18 through pivot pins 26. Material handling unit or bucket 24 is pivoted about the outer end of boom 18 by hydaulic means including a fluid ram 30 and a linkage 32 interposed between boom 18 and bucket 24. The hydraulic circuit (the details of which are not shown) also incorporates a manual control lever 34 pivoted about a fixed pivot axis in the operator's compartment for the vehicle. Control lever 34 is pivoted in a counterclockwise direction as viewed in FIG. 1 to pivot the bucket 24 in a clockwise direction with respect to pivot pin 26 while pivotal movement of the lever 34 in a clockwise direction will pivot bucket 24 in a counterclockwise direction, as is well known in the art.

Figure 2:
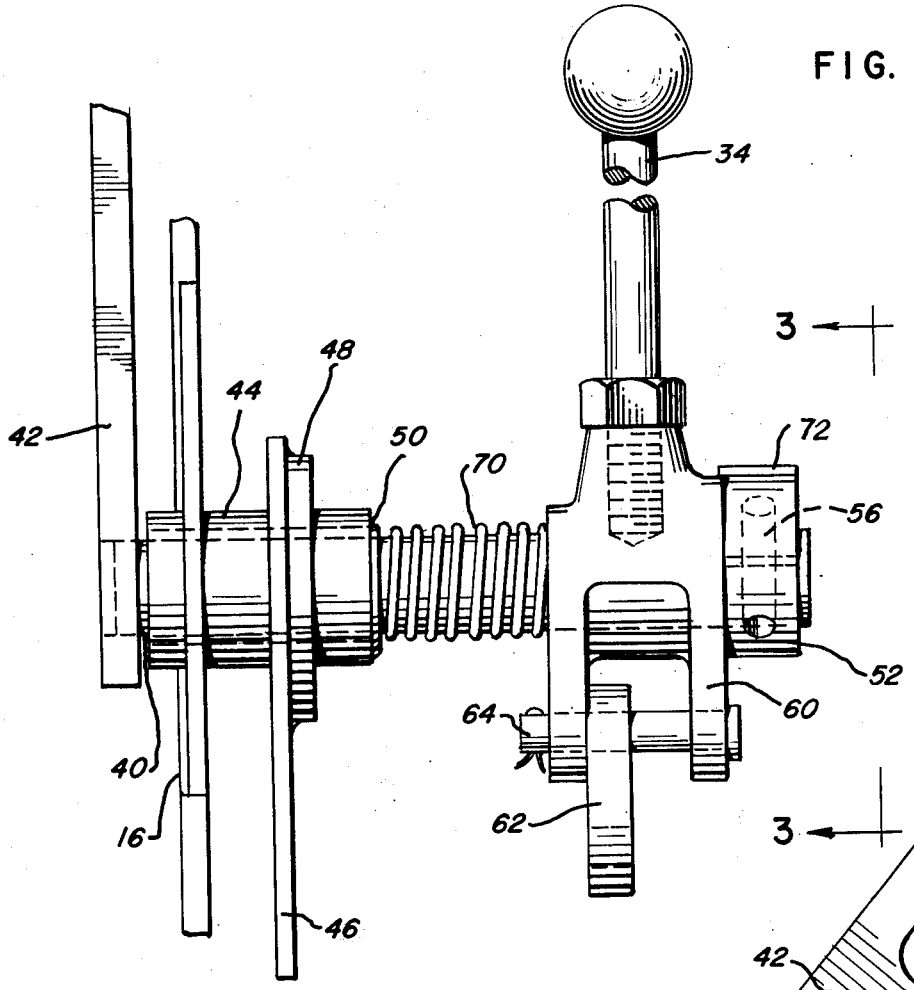
FIG. 2 is an enlarged view, as viewed along line 2—2 of FIG. 1, showing the anti-rollback mechanism.
Figure 3:
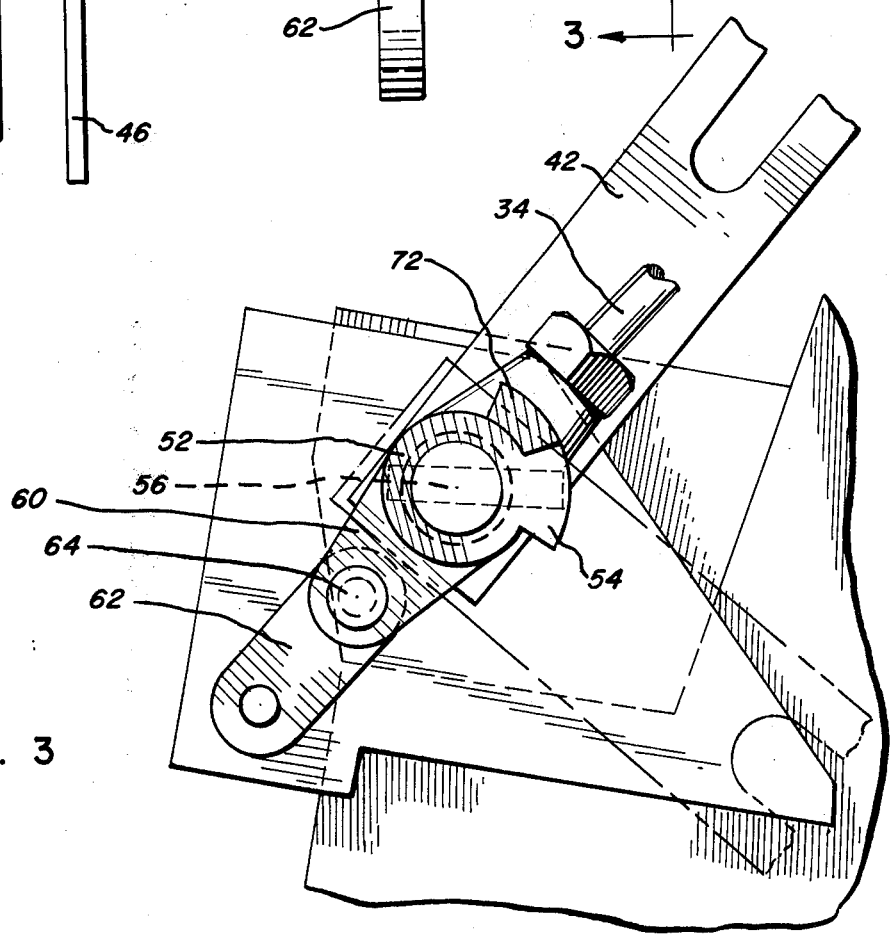
FIG. 3 is a end view of the mechanism as viewed along line 3—3 of FIG. 2.
Figure 4:
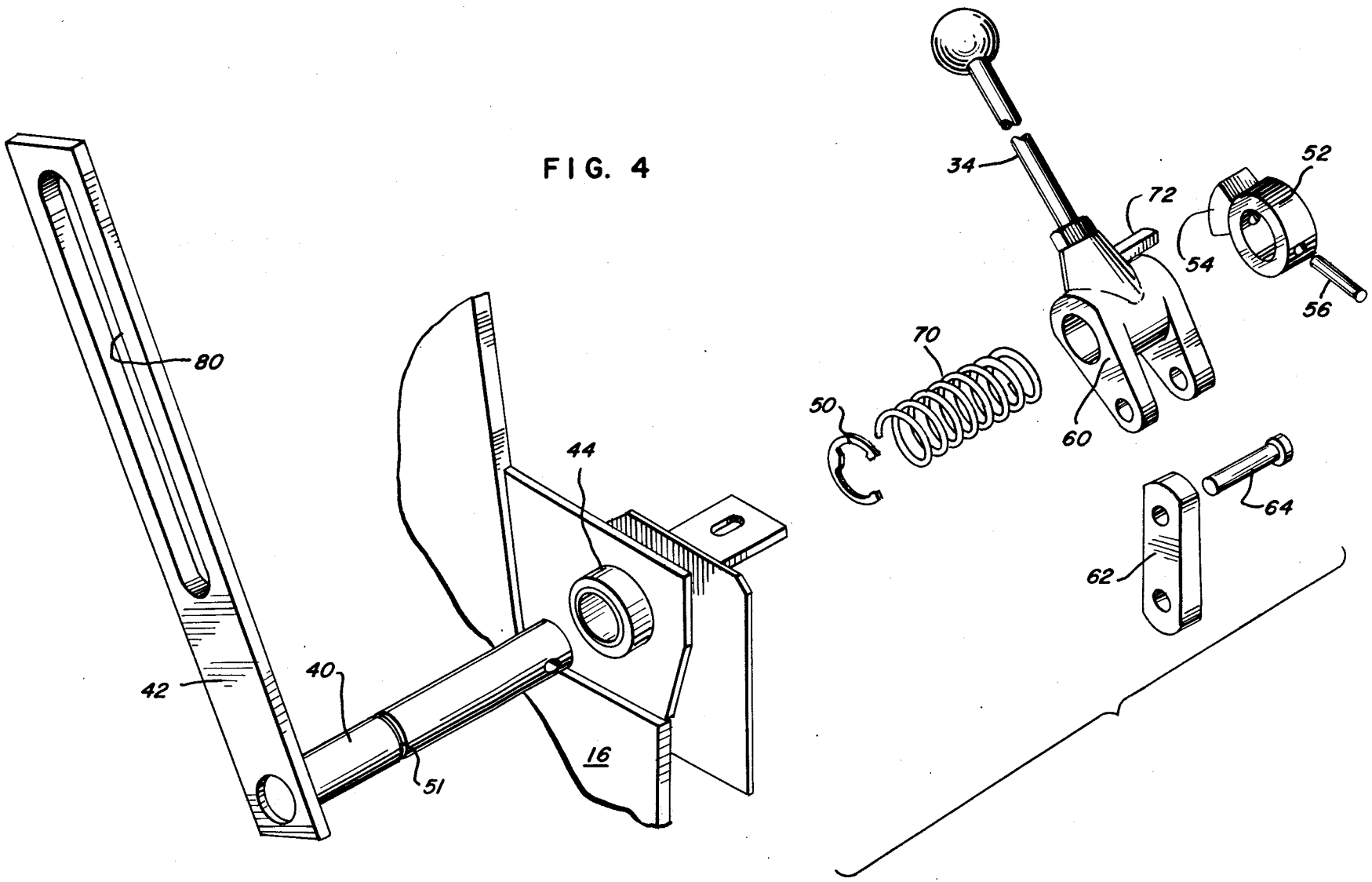
FIG. 4 is a enlarged exploded view of the anti-rollback mechanism.

The details of the position defining means and its interrelationship with control lever 34 are shown in FIGS. 2, 3 and 4 and will be described before the overall operation is considered.

As shown in FIG. 2, position defining means includes a shaft 40 having an arm 42 fixedly secured to one end thereof and extending radially therefrom. Shaft 40 is rotatably supported in a bushing 44 that is fixed to body 16 and has a rigid reinforcing plate 46 adjacent an opposite end thereof with a collar 48 welded thereto. A spring clip 50 is received into a groove 51 on shaft 40 to position the shaft with respect to collar 44.

The opposite end of shaft 40 has a second collar 52 secured thereto with collar 52 having an enlarged portion 54 (FIG. 3) extending radially therefrom, for a purpose that will be described later. Collar 52 is preferably secured to the end of shaft 40 by a roll pin 56.

As most clearly shown in FIG. 2, control lever 34 is rotatably supported on shaft 40 and has a clevis portion 60 at the lower end thereof. Clevis portion 60 supports a link 62 through a clevis pin 64 and the opposite end of link 62 is adapted to be connected to the control spool (not shown) of a valve that is actuated in opposite directions from a neutral position to supply hydraulic fluid to opposite ends of fluid ram 30 and pivot the bucket 24 with respect to boom 18. Control lever 34 is normally biased to a first position by a coil spring or biasing means 70 interposed between spring clip 50 and an adjacent surface of the portion of the control lever which is rotatably supported on shaft 40. Thus, biasing means 70 normally biases control lever 34 into engagement with collar 52. It will also be noted in FIG. 3 that clevis portion 60 of lever 34 has an axial extension 72 which is in circumferential alignment with abutment 54.

Referring now to FIGS. 1 and 4, it will be noted that arm 42 on the end of shaft 40 has an elongated slot 80 defined therein. Slot 80 receives a pin or bolt 82 that is secured to the lower surface of boom 18 through a bracket 84. Thus, the rotated position of shaft 40 within hub or collar 44 defines the position of boom 18 with respect to vehicle 12.

As will now be appreciated, shaft 40, arm 42 and collar 52 will be moved in response to movement of boom 18 with respect to vehicle 12 and thus define position defining means adjcent lever 34 which defines the position of boom or lift arms 18 on vehicle 12. The abutment 54, which is located in the path of movement of control lever 34, defines the position of the boom with respect to the vehicle.

Assuming that the lift arms or boom are in a fully raised position with respect to vehicle 12, as shown in phantom line position in FIG. 1, position defining means which includes abutment 54, shaft 40 and arm 42 will be in the position illustrated in FIG. 3. In this position, abutment 54 is almost in contact with extension 72 that forms part of control lever 34. This means that the control lever cannot be rotated in a clockwise direction, as viewed in FIG. 3, thereby preventing the bucket from being inadvertently pivoted in a counterclockwise direction, as viewed in FIG. 1. This eliminates the possibility of having the operator inadvertently dump the contents of the bucket over the rear edge thereof. However, should the operator desire to manually override the mechanism, it is only necessary for him to grasp control lever 34 and shift the lever to the left as viewed in FIG. 2 to a position where rigid extension 72 no longer is in alignment with abutment 54. At this point in time, the operator can move control lever in a clockwise direction, as viewed in FIG. 3, and thereby cause the bucket 24 to be pivoted in a counterclockwise direction as viewed in FIG. 1. While control lever 34 is in such actuated position, it will be appreciated that extension 72 will be biased into engagement with the end of abutment 54. If the operator then subsequently pivots the control lever in the opposite direction, when the control lever reaches the neutral position, as illustrated in FIG. 3, the bias of spring 70 will automatically return the control lever to the position indicated in FIG. 2.

Summarizing the above, it will be appreciated that abutment 54 of position defining means is positioned as a function of the position of boom 18 with respect to vehicle 12 and in the fully raised position of boom 18, abutment 54 cooperates with lever 34, more specifically extension 72, to prevent actuation of the lever in one direction. The spring 70 defines means that accommodates relative movement between lever 34 and abutment 54 to allow pivotal movement of the lever in this same direction after the lever has been shifted axially with respect to shaft 40, which defines the pivot axis for the lever.

As can be seen from the above description, the present invention provides a simple and inexpensive mechanism for normally preventing rolling back of the bucket when it is in the fully raised position but will automatically allow the operator to manually override this function at times when the need arises.

While a specific embodiment of the invention has been shown and described, numerous modifications are apparent. For example, the bolt 82 and slot 80 arrangement for causing arm 42 to move as a function of boom 18 could readily be changed. For example, arm 42 could normally be biased into engagement with boom 18 so that arm 42 and subsequently abutment 54 would still be positioned as a function of boom 18. Also abutment 54 could readily be an integral extension on shaft 40.

I claim:

1. In an elongated vehicle having a lift arm pivotally supported at one end with means for raising and lowering said arm, a material handling unit pivotally supported on a free end of said lift arm with hydraulic means for pivoting said unit on said arm, said hydraulic means including a lever pivoted on a pivot axis in opposite directions from a neutral position to pivot said unit forward and rearward with respect to said vehicle; position defining means adjacent said lever defining the position of said arm on said vehicle, said position defining means including an abutment disposed in the pivotal path of movement of said lever to prevent actuation of said lever in one direction when said arm is in a fully raised position with respect to said vehicle, said lever being laterally shiftable on said pivot axis to accommodate relative movement between said lever and said abutment and allow pivotal movement of said lever in said one direction beyond said abutment.

2. A vehicle as defined in claim 1, in which said pivot axis is defined by a shaft on said vehicle and in which said means accommodating movement of said lever includes biasing means normally biasing said lever to a first position with respect to said shaft.

3. A vehicle as defined in claim 2, in which said shaft is rotatably supported on said vehicle and forms part of said position defining means.

4. In an elongated vehicle having a lift arm pivotally supported at one end with means for raising and lowering said arm, a material handling unit pivotally supported on a free end of said lift arm with hydraulic means for pivoting said unit on said arm, said hydraulic means including a shaft rotatably supported on said vehicle, said shaft defining the position of said arm on said vehicle; a lever pivoted on said shaft in opposite directions from a neutral position to pivot said unit forward and rearward with respect to said vehicle; an abutment fixed to said shaft and disposed in the pivotal path of movement of said lever to prevent actuation of said lever in one direction when said arm is in a fully raised position with respect to said vehicle; and biasing means normally biasing said lever toward said abutment, said biasing means accommodating relative movement between said lever and said shaft to allow pivotal movement of said lever in said one direction beyond said abutment.

5. A vehicle as defined in claim 4, in which said shaft has an elongated arm secured thereto and cooperating with said lift arm so that said shaft is rotated in response to movement of said arm.

6. In a vehicle having a boom pivotally supported at one end of the vehicle with means for raising and lowering the boom, a material handling unit pivotally supported on a free end of said boom with hydraulic means for pivoting said unit on said boom, said hydraulic means including a lever rotatably supported on an axis defined by a shaft on said vehicle, means between said shaft and said boom for rotatably positioning said shaft as a function of the raised and lowered position of said boom on said vehicle, means on said shaft located in the pivotal path of movement of said lever to prevent movement of said lever in one direction when said boom is in a fully raised position with respect to said vehicle, and biasing means cooperating with said lever and accommodating axial shifting of said lever with respect to said shaft to allow pivotal movement of said lever in said one direction when said boom is in a fully raised position.

* * * * *